US009632471B2

(12) United States Patent
Sato et al.

(10) Patent No.: US 9,632,471 B2
(45) Date of Patent: Apr. 25, 2017

(54) SHEET CONVEYANCE APPARATUS AND IMAGE FORMING APPARATUS

(71) Applicant: CANON KABUSHIKI KAISHA, Tokyo (JP)

(72) Inventors: Kengo Sato, Koshigaya (JP); Masaki Kakitani, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/874,656

(22) Filed: Oct. 5, 2015

(65) Prior Publication Data

US 2016/0103411 A1 Apr. 14, 2016

(30) Foreign Application Priority Data

Oct. 9, 2014 (JP) ..... 2014-208312

(51) Int. Cl.
*G03G 15/00* (2006.01)
*B65H 5/06* (2006.01)
*B65H 27/00* (2006.01)

(52) U.S. Cl.
CPC ..... *G03G 15/6576* (2013.01); *B65H 5/062* (2013.01); *B65H 27/00* (2013.01); *G03G 15/6552* (2013.01); *G03G 15/6573* (2013.01); *B65H 2401/113* (2013.01); *B65H 2404/143* (2013.01); *B65H 2404/185* (2013.01); *B65H 2801/06* (2013.01)

(58) Field of Classification Search
CPC ..... G03G 15/6576
USPC ..... 399/406
See application file for complete search history.

(56) References Cited

U.S. PATENT DOCUMENTS

| | | | |
|---|---|---|---|
| 5,091,754 | A | 2/1992 | Abe et al. |
| 5,154,411 | A | 10/1992 | Saito et al. |
| 5,172,138 | A | 12/1992 | Okazawa et al. |
| 5,287,157 | A | 2/1994 | Miyazato et al. |
| 5,481,336 | A | 1/1996 | Tachibana et al. |
| 5,812,923 | A | 9/1998 | Yamauchi et al. |

(Continued)

FOREIGN PATENT DOCUMENTS

| | | | |
|---|---|---|---|
| JP | 59-108642 | | 6/1984 |
| JP | 09-30712 | A | 2/1997 |
| JP | 2004-59237 | A | 2/2004 |

OTHER PUBLICATIONS

United Kingdom Office Action issued in corresponding GB application No. GB1517829.6 dated Mar. 4, 2016.

*Primary Examiner* — Anthony Nguyen
(74) *Attorney, Agent, or Firm* — Fitzpatrick, Cella, Harper & Scinto

(57) ABSTRACT

A sheet conveyance apparatus is equipped with a first rotator, a second rotator conveying a sheet together with the first rotator, a cam member changing a position of the second rotator with respect to the first rotator, a drive unit rotating the cam member, and a load portion applying load on a rotation of the cam member. The load portion includes a contact member having a cam surface formed on a side surface in an axial direction of the cam member, an abutment member capable of abutting against the cam surface, and a biasing member biasing one of the contact member and the abutment member toward the other, a biasing force of the biasing member converted into a force, applying load to the rotating cam member, by the cam surface opposing to a rotating direction in which the cam member is driven by the drive unit.

16 Claims, 20 Drawing Sheets

(56) References Cited

U.S. PATENT DOCUMENTS

| | | | | |
|---|---|---|---|---|
| 5,848,347 | A * | 12/1998 | Kuo | B65H 29/12 162/271 |
| 6,259,888 | B1 * | 7/2001 | Kazama | B65H 29/12 271/183 |
| 6,487,379 | B2 | 11/2002 | Sato | |
| 6,496,660 | B2 | 12/2002 | Takahashi et al. | |
| 6,581,922 | B2 | 6/2003 | Kuwata et al. | |
| 6,674,976 | B2 | 1/2004 | Sato et al. | |
| 6,785,478 | B2 | 8/2004 | Takahashi et al. | |
| 8,794,618 | B2 * | 8/2014 | Kondo | B65H 3/0607 271/152 |
| 2005/0063747 | A1 * | 3/2005 | Ushio | G03G 15/6576 399/406 |
| 2005/0220520 | A1 * | 10/2005 | Kawamoto | G03G 15/6576 399/405 |
| 2006/0163892 | A1 * | 7/2006 | Nguyen | B66C 1/48 294/103.1 |
| 2009/0257802 | A1 * | 10/2009 | Eda | B65H 37/00 399/406 |
| 2011/0229178 | A1 * | 9/2011 | Ogawa | G03G 15/6576 399/67 |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus for conveying sheets, and an image forming apparatus equipped with the sheet conveyance apparatus.

Description of the Related Art

In an image forming apparatus for forming images via an electrophotographic method according to the prior art, a toner image formed in an image forming portion is transferred to a sheet supplied from a feeding portion, and then the sheet is guided to a fixing unit where unfixed toner on the sheet is fixed to the sheet. A sheet processing apparatus is connected to such image forming apparatus for processing the sheet on which the image has been formed, such as sorting, stapling, punching and the like.

When fixing the toner image on the sheet by applying heat and pressure to the sheet via the fixing unit, the sheet may be curled (deformed). When the sheet is deformed, jamming of the sheet may occur in the sheet processing apparatus, or processing accuracy such as stacking performance or aligning performance may be affected. Therefore, the curling of the sheet must be corrected in order to improve the quality of the processed sheet.

In the prior art, a curl correcting apparatus is known where a curled sheet is subjected to curling in the opposite direction as the formed curl. One example of such curl correcting apparatus is equipped with a first curl correcting portion where a curl curved upward in a convex is corrected, and a second curl correcting portion where a curl curved downward in a convex is corrected. Then, according to the direction of the curl, the sheet having been curled is corrected using at least either one of the first curl correcting portion and the second curl correcting portion.

The curling of a sheet occurs, for example, by the toner transferred onto a sheet being melted by the heat applied in a fixing unit, and then being condensed by cooling. The size of the curl on the sheet varies, depending on the type of the sheet, temperature and humidity, image density, and so on. Therefore, when correcting the curl using the curl correcting apparatus, an amount of correction of curl by the first and second curl correcting portions is determined based, for example, on the temperature and humidity, a moisture content of the sheet, the sheet type, sheet thickness, the image density and so on.

Each curl correcting portion of the curl correcting apparatus is normally equipped with a hard roller for conveying a sheet and a soft roller pressed against the hard roller. Then, when pressing the soft roller against the hard roller, a nip portion being curved, by the hard roller penetrating the soft roller, is formed, and the curled sheet is passed through the curved nip portion to correct the curl.

Now, when correcting the curl, a pressing force of the hard roller against the soft roller is changed to thereby change an amount of insertion (amount of penetration) of the hard roller to the soft roller, by which the amount of correction of the curl can be adjusted. The amount of insertion (amount of penetration) is changed as described, wherein Japanese Patent Application Laid-Open Publication No. 9-30712 provides a curl correcting portion using a motor and a cam member to change the position of one of the rollers.

However, when changing the amount of penetration (pressing force) of a roller pair by the cam member, an area on an upward slope side of the cam member will not be an issue, but a force in a same direction as a direction of rotation acts on a downward slope-side area of the cam member from a cam follower. In that case, a rotation speed of the cam member will exceed a rotation speed being rotated by the motor, and thus, an amount of rotation of the cam member is increased and an adjustment position of the cam member is displaced.

And as a result, the position of the roller pair may be displaced from a given position. Especially in the curl correcting apparatus where a large pressing force is applied to the roller pair compared to a normal conveyance roller for conveying the sheet, the rotation force acting on the cam member from the cam follower is increased, and the problem becomes more significant.

Further according to the curl correcting apparatus, the position of the hard roller with respect to the soft roller must be changed to a plurality of locations, and positional accuracy of the hard roller at each position becomes important. When the cam member is displaced, the curl correction amount will be dispersed, and insufficient correction or excessive correction may occur. Furthermore, the position of the roller pair is not only displaced from the given position, but a negative torque occurs to the motor, so that step-out of the motor may occur.

Therefore, in a sheet conveyance apparatus taught in Japanese Patent Application Laid-Open Publication No. 2004-59237, a brake panel is pressed against an outer circumferential surface of the cam member within a given range of angle of rotation of the cam member, by which a brake force is applied to the rotation of the cam member, and the rotation of the cam member.

However, by regulating the rotation of the cam member by pressing a brake panel against the outer circumferential surface of the cam member as described, friction force may be varied by the chipping of the brake panel or the deterioration of surface durability, and the brake force. That is, the regulating force regulating the rotation of the cam member, is varied. Furthermore, the slidability between the cam member and the brake panel is changed and the load may be varied drastically, and in that case, step-out of the motor or noise may occur.

SUMMARY OF THE INVENTION

According to a first aspect of the present invention, a sheet conveyance apparatus includes a first rotator; a second rotator conveying a sheet together with the first rotator; a cam member changing a position of the second rotator with respect to the first rotator; a drive unit rotating the cam member; and a load portion applying load on a rotation of the cam member. The load portion includes a contact member having a cam surface formed on a side surface intersecting a line extending in an axial direction of the cam member; an abutment member capable of abutting against the cam surface; and a biasing member biasing one of the contact member and the abutment member toward the other such that the cam surface of the contact member and the abutment member come into contact each other, wherein a biasing force of the biasing member is converted into a force, applying load to the rotating cam member, by the cam surface opposing to a rotating direction in which the cam member is driven by the drive unit.

According to a second aspect of the present invention, a sheet conveyance apparatus includes a first rotator; a second rotator conveying a sheet together with the first rotator; a cam member changing a position of the second rotator with respect to the first rotator; a drive unit rotating the cam member; a contact member including a cam surface, slanted in the axial direction along a direction of rotation, formed on a side surface in an axial direction of the cam member; an abutment member having an projection capable of being abutted against the cam surface; and a biasing member biasing one of the contact member and the abutment member to the other such that the cam surface and the projection are abutted against one another.

Further features of the present invention will become apparent from the following description of exemplary embodiments with reference to the attached drawings.

DESCRIPTION OF THE EMBODIMENTS

Figure 1:
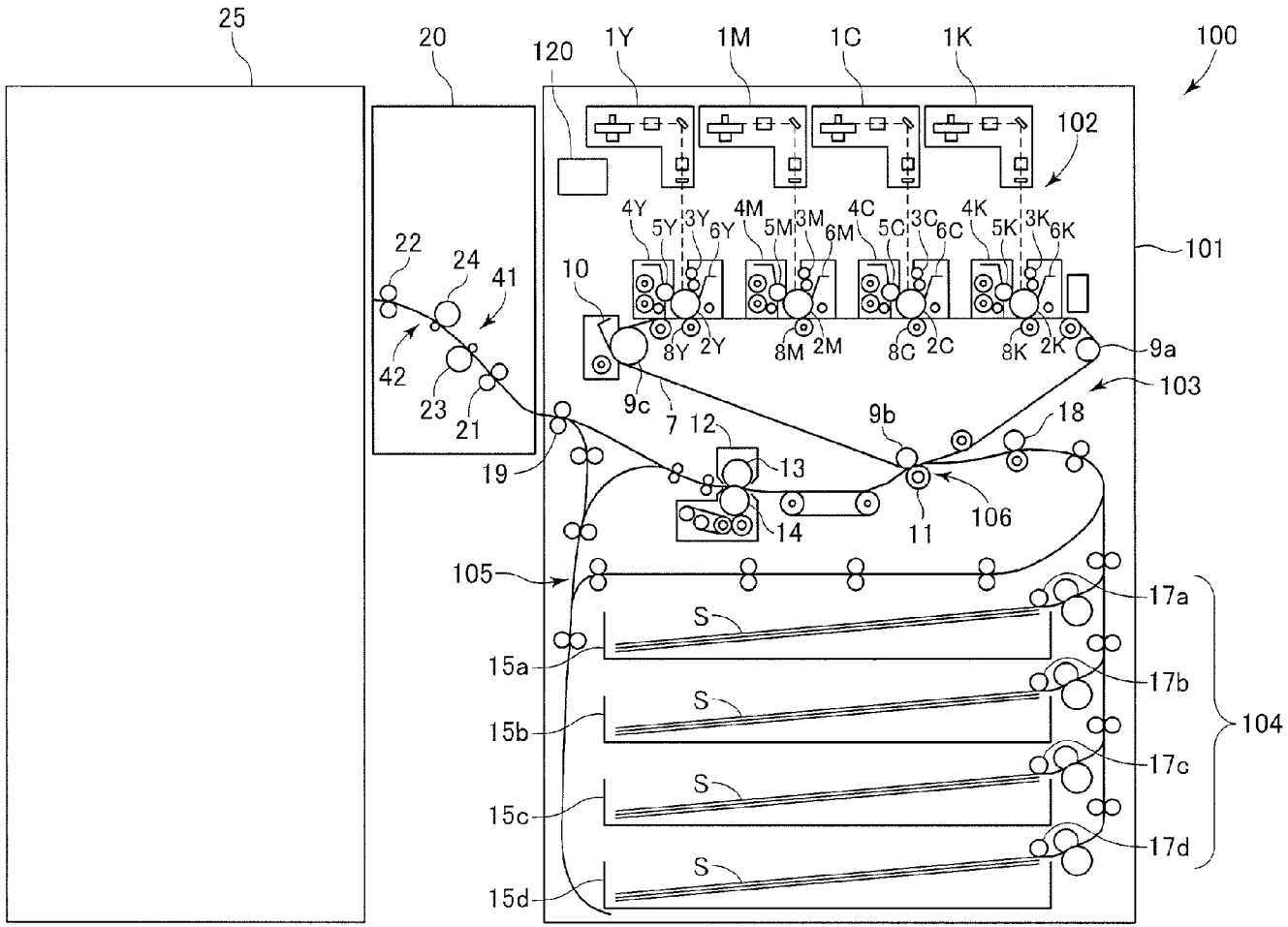
FIG. 1 is a view showing a configuration outline of a color laser printer as an example of an image forming apparatus equipped with a sheet conveyance apparatus according to one preferred embodiment of the present invention.

Now, a preferred embodiment for carrying out the present invention will be described with reference to the drawings. FIG. 1 is a view illustrating a configuration outline of a color laser printer as an example of an image forming apparatus having a sheet conveyance apparatus according to a preferred embodiment of the present invention. As shown in FIG. 1, a color laser printer 100 is equipped with a color laser printer body 101 (hereinafter referred to as printer body), a sheet processing apparatus 25 performing processes such as sorting, stapling and punching of sheets, and a curl correcting apparatus 20 disposed between the printer body 101 and the sheet processing apparatus 25. The printer body 101 is equipped with an image forming portion 102 forming an image on a sheet S, an intermediate transfer portion 103, a fixing unit 12, and a sheet feeding apparatus 104 for feeding a sheet S to the image forming portion 102.

The image forming portion 102 is equipped with four processing stations 4Y, 4M, 4C and 4K arranged substantially horizontally for forming toner images of four colors, which are yellow (y), magenta (m), cyan (c) and black (k). The image forming portion 102 is also equipped with four scanner units 1Y, 1M, 1C and 1K.

The processing station 4Y is equipped with a photosensitive drum 2Y which is an image bearing member bearing an yellow toner image and driven by a stepping motor not illustrated. Further, the processing station 4Y is equipped with a charging roller 3Y, a developing portion 5Y, and a cleaner portion 6Y for cleaning the photosensitive drum 2Y. The charging roller 3Y, the developing portion 5Y, the cleaner portion 6Y and so on are arranged in the circumference of the photosensitive drum 2Y respectively along a direction of rotation of the photosensitive drum 2. The processing stations 4M, 4C and 4K have a similar configuration as the above-described processing station 4Y, except for the difference in toner color.

The sheet feeding apparatus 104 is disposed at a lower portion of the printer body, and is equipped with four sheet paper cassettes 15*a* through 15*d* arranged in different levels, which are sheet storing portions for storing sheets, and pickup rollers 17*a* through 17*d* for sending out sheets S loaded and stored in the respective sheet paper cassettes.

The intermediate transfer portion 103 is equipped with an intermediate transfer belt 7 driven to rotate along the direction of arrangement of the respective processing stations 4Y, 4M, 4C and 4K in synchronization with a circumferential velocity of the photosensitive drums 2Y, 2M, 2C and 2K. Here, the intermediate transfer belt 7 is stretched by a drive roller 9*a*, a secondary transfer inner roller 9*b*, and a tension roller 9*c* providing an appropriate tension to the intermediate transfer belt 7 by a biasing force of a spring not shown.

In the inner side of the intermediate transfer belt 7 are arranged four primary transfer rollers 8Y, 8M, 8C and 8K respectively nipping the intermediate transfer belt 7 with the photosensitive drums 2Y, 2M, 2C and 2K, and forming a primary transfer portion. These primary transfer rollers 8Y, 8M, 8C and 8K are connected to a transfer bias power supply not shown. Further, a secondary transfer outer roller 11 is arranged to face the secondary transfer inner roller 9*b*. The secondary transfer outer roller 11 contacts a lowermost surface of the intermediate transfer belt 7, nips the sheet S having been conveyed by a registration roller pair 18 with the intermediate transfer belt 7, and conveys the same. The fixing unit 12 is equipped with a fixing roller 13 and a pressure roller 14, and fixes a toner image formed on the sheet S via the intermediate transfer belt 7 onto the sheet S.

The color laser printer 100 is designed so that images can also be formed on a rear surface of the sheet, and therefore, the printer body 101 has a re-conveyance portion 105 for turning over the sheet S having an image formed on the front surface (one surface) thereof and conveying the sheet again to the image forming portion 102. Further, the printer body 101 is equipped with a controller 120, which is a control means for controlling an image forming operation of the image forming portion 102, a sheet feeding operation of the sheet feeding apparatus 104, a processing operation of the sheet processing apparatus 25, a curl correcting operation of the curl correcting apparatus 20 described later, and so on.

Next, we will describe the image forming operation of the color laser printer 100 having the above-described configuration. At first, when an image signal is entered from a personal computer or the like not shown to a scanner unit 1, a laser beam corresponding to the image signal is irradiated from the scanner unit 1 to photosensitive drums in the respective processing stations 4. At this time, the surface of each photosensitive drum 2 is charged homogeneously to a given polarity and potential via the charging roller 3, and when the laser beam is irradiated from the scanner unit 1, an electrostatic latent image is formed on the surface.

Thereafter, the electrostatic latent image is developed by the developing portion 5, and toner images of four colors, which are yellow, magenta, cyan and black, are formed on the photosensitive drums of the respective processing stations 4Y, 4M, 4C and 4K. Then, the four-colored toner images are sequentially transferred to the intermediate transfer belt 7 via a primary transfer bias applied to the primary transfer rollers 8Y, 8M, 8C and 8K to form a full-color toner image onto the intermediate transfer belt 7. After transferring the toner images, the toner remaining on the surface of the photosensitive drums 2Y, 2M, 2C and 2K are removed via cleaner portions 6Y, 6M, 6C and 6K.

Simultaneously as the operation for forming the toner image, the sheet S stored in sheet paper cassettes 15*a* through 15*d* is sent out by one of the pickup rollers 17*a* through 17*d*, and then conveyed by the registration roller pair 18 where distortion is corrected. Thereafter, the sheet S is conveyed to a secondary transfer portion 106 configured of the secondary transfer inner roller 9*b* and the secondary transfer outer roller 11 at a timing determined by the registration roller pair 18.

Then, in the secondary transfer portion 106, a bias having a positive polarity is applied to the secondary transfer outer roller 11, so that a full-colored toner image on the intermediate transfer belt 7 is secondarily transferred to the conveyed sheet S. Then, the residual toner remaining on the intermediate transfer belt 7 is stored in a cleaner container 10.

After the toner image has been transferred, the sheet S is conveyed to the fixing unit 12, where heat and pressure are applied by the fixing roller 13 and the pressure roller 14, and the toner image is fixed to the surface of the sheet S. Thereafter, the sheet S to which a full-color toner image has been fixed is conveyed to the curl correcting apparatus 20 by a discharge roller pair 19.

When forming images on both sides of the sheet, the sheet having an image formed on one side thereof is conveyed by the re-conveyance portion 105 to the registration roller pair 18, and thereafter, the sheet is conveyed by the registration roller pair 18 to the secondary transfer portion 106, where a toner image is transferred to a second surface. Then the sheet S having the toner image transferred on the second surface has its toner image fixed via the fixing unit 12, and then the sheet is conveyed by the discharge roller pair 19 toward the curl correcting apparatus 20.

Figure 2A:
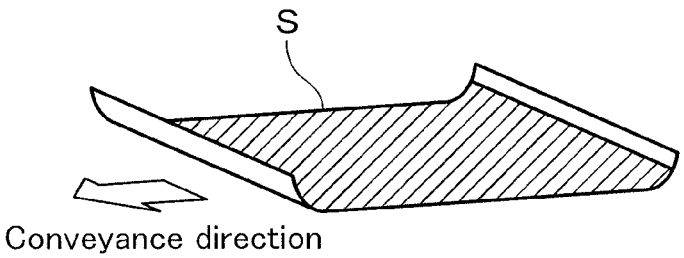
FIG. 2A is a perspective view showing a state where a front end and a rear end of a sheet are curled upward.
Figure 2B:
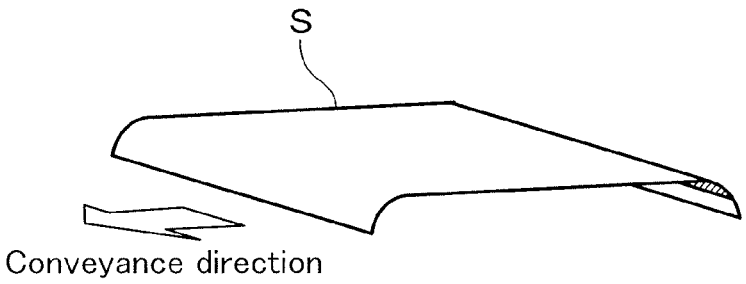
FIG. 2B is a perspective view showing a state where a front end and a rear end of a sheet are curled downward.

Regarding the sheet S discharged via the discharge roller pair 19, a moisture content balance within the plane of the sheet is varied by the influence of change of temperature and humidity or the influence of the sheet being heated in the fixing unit 12, for example, and a curl occurs to the sheet, as shown in FIGS. 2A and 2B. The curl may also occur by the sheet being stiffened by being nipped by the conveyance roller or nipped for fixture, or by the difference of cooling speed, contraction percentage and the like of the toner, the front side of the sheet and the rear side of the sheet, when the toner image is fixed via heating.

When curling occurs to the sheet, jamming of the sheet may occur when the sheet is processed via the sheet processing apparatus 25, or the curling may influence the accuracy of processes such as a stacking performance or an aligning performance. Therefore, according to the present embodiment, a curl correcting apparatus 20 is provided between the printer body 101 and the sheet processing apparatus 25. After correcting the curling of the sheet by the curl correcting apparatus 20 as the sheet conveyance apparatus, the sheet is conveyed to the sheet processing apparatus 25.

Figure 3:
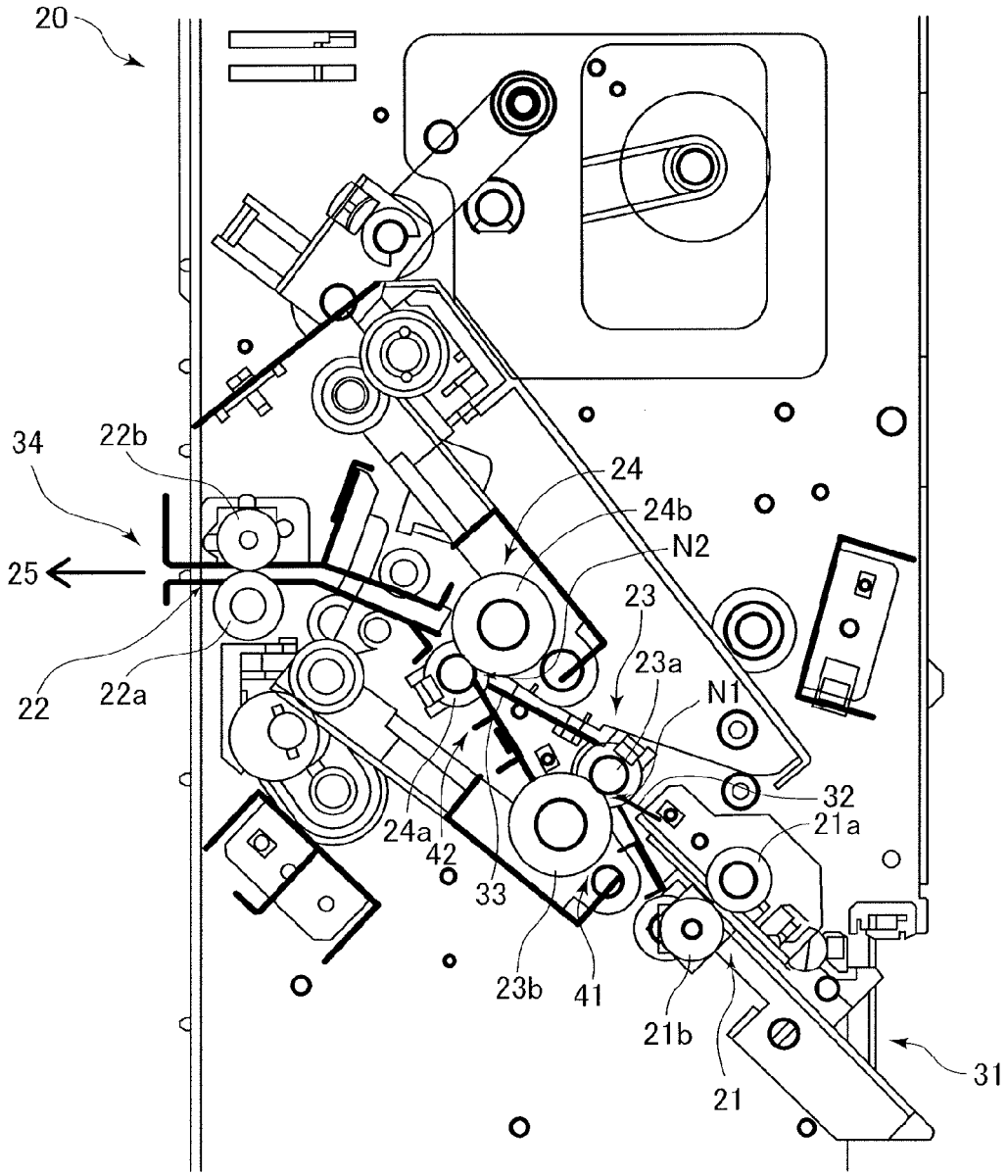
FIG. 3 is a view illustrating a configuration of a curl correcting apparatus as a sheet conveyance apparatus.

Next, the curl correcting apparatus 20 according to the present embodiment will be described with reference to FIG. 3. As shown in FIG. 3, the curl correcting apparatus 20 is equipped with an upstream curl correcting portion 41 having an upstream curl correcting roller pair 23, and a downstream curl correcting portion having a downstream curl correcting roller pair 24. The upstream curl correcting roller pair 23 is composed of an upstream curl correcting roller 23*a* (third rotator) formed of a metal member, such as SUS, and driven to rotate by a drive unit not shown, and an upstream following roller 23*b* (fourth rotator) formed of a soft elastic member, such as foamed polyurethane, and pressed against the upstream curl correcting roller 23*a*.

The downstream curl correcting roller pair 24 is composed of a downstream curl correcting roller 24*a* (first rotator) formed of a metal member, such as SUS, and driven to rotate by a drive unit not shown, and a downstream following roller 24*b* (second rotator) formed of a soft elastic member, such as foamed polyurethane, and pressed against the downstream curl correcting roller 24*a*. The upstream following roller 23*b* and the downstream following roller 24*b* are pressed against the upstream curl correcting roller 23*a* and the downstream curl correcting roller 24*a*, while changing an amount of penetration in response to a phase of a cam member described later.

Further, the curl correcting apparatus 20 is equipped with an entrance roller pair 21 and an exit roller pair 22 for conveying the sheet S, wherein the entrance roller pair 21 is composed of an entrance conveyance drive roller 21*a* formed of an elastic rubber member, such as EPDM, driven to rotate by a drive unit not shown, and an entrance conveyance following roller 21*b* formed of a plastic member, such as POM, and pressed against the entrance conveyance drive roller 21*a* via a biasing member not shown. The exit roller pair 22 is composed of an exit conveyance drive roller 22*a* formed of an elastic rubber member, such as EPDM, driven to rotate by a drive unit not shown, and an exit conveyance following roller 22*b* formed of a plastic member, such as POM, and pressed against the exit conveyance drive roller 22*a* by a biasing member not shown.

Figure 4:
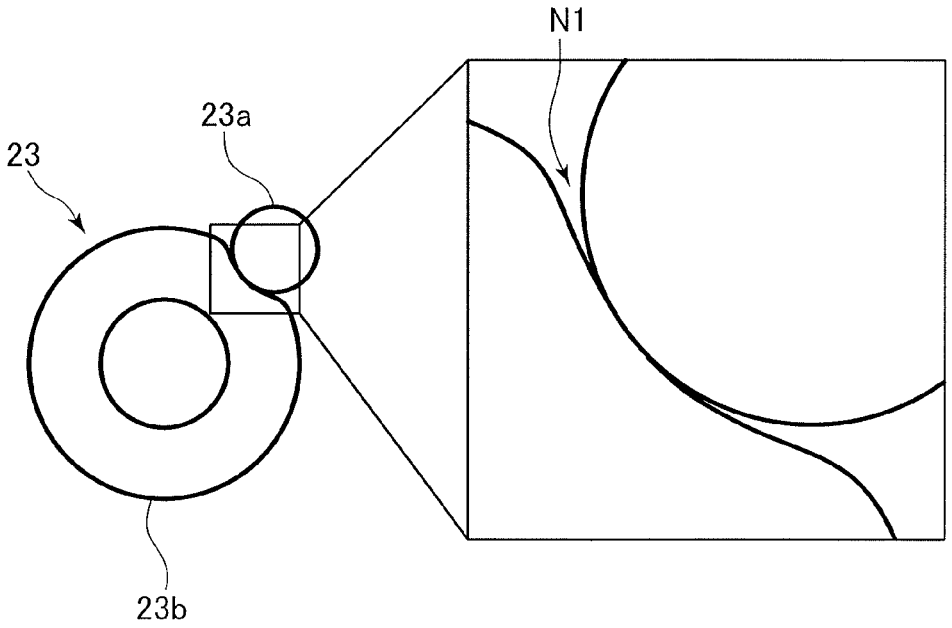
FIG. 4 is a view illustrating a nip portion of an upstream curl correction roller pair disposed in the curl correcting apparatus.

A nip portion N1 of the upstream curl correcting roller pair 23 is curved, for example, by the upstream curl correcting roller 23*a* as hard roller penetrating into the upstream following roller 23*b* as elastic roller, as shown in FIG. 4. Then, the upstream curl correcting roller pair 23 having the nip portion N1 curved as described corrects the curl of the sheet in a convex shape where both ends of the sheet in the conveyance direction are curved downward, as shown in FIG. 2B. Further, the downstream curl correcting roller pair 24 corrects the curl of the sheet in a concave shape where both ends of the sheet in the conveyance direction are curved upward, as shown in already described FIG. 2A.

In order to increase the curl correction amount, the nip portion N1 must have a large curvature, and therefore, the roller used as the upstream curl correcting roller 23*a* should preferably have a smaller diameter than other conveyance rollers, and in the present embodiment, a roller having a diameter of 8 mm is used. Further, the upstream following roller 23*b* having a lower hardness than the upstream curl correcting roller 23*a* should preferably have a large diameter, and in the present embodiment, a roller having a diameter of 24 mm is used. The downstream curl correcting roller 24*a* and the downstream following roller 24*b* are configured similarly.

As described, when a large curvature is secured as the nip portion N1 using the small-diameter upstream curl correcting roller 23*a* and the large-diameter upstream following roller 23*b*, the width of the distance between the two rollers 23*a* and 23*b* at the entrance of the nip portion N1 will be narrowed compared to other conveyance rollers. Therefore, an upstream conveyance guiding portion 32 is provided to covey the sheet S toward the narrow entrance of the nip portion N1, as shown in already-described FIG. 3. A downstream conveyance guiding portion 33 is provided to convey the sheet S toward the entrance of nip portion N2 formed by the downstream curl correcting roller 24*a* and the downstream following roller 24*b*, as shown in already-described FIG. 3.

Then, when a sheet is conveyed from an entrance portion 31 to the curl correcting apparatus 20 having the above-described configuration, the sheet S is conveyed via the upstream conveyance guiding portion 32 to the nip portion N1 of the upstream curl correcting roller pair 23, when the convex-shaped curl is corrected. Thereafter, the sheet is conveyed to the nip portion N2 of the downstream curl correction roller pair 24 by the downstream conveyance guiding portion 33, when the concave-shaped curl is corrected. Then, the sheet is conveyed from an exit portion 34 to the sheet processing apparatus 25 in the state where the curls are corrected as described.

Figure 5A:
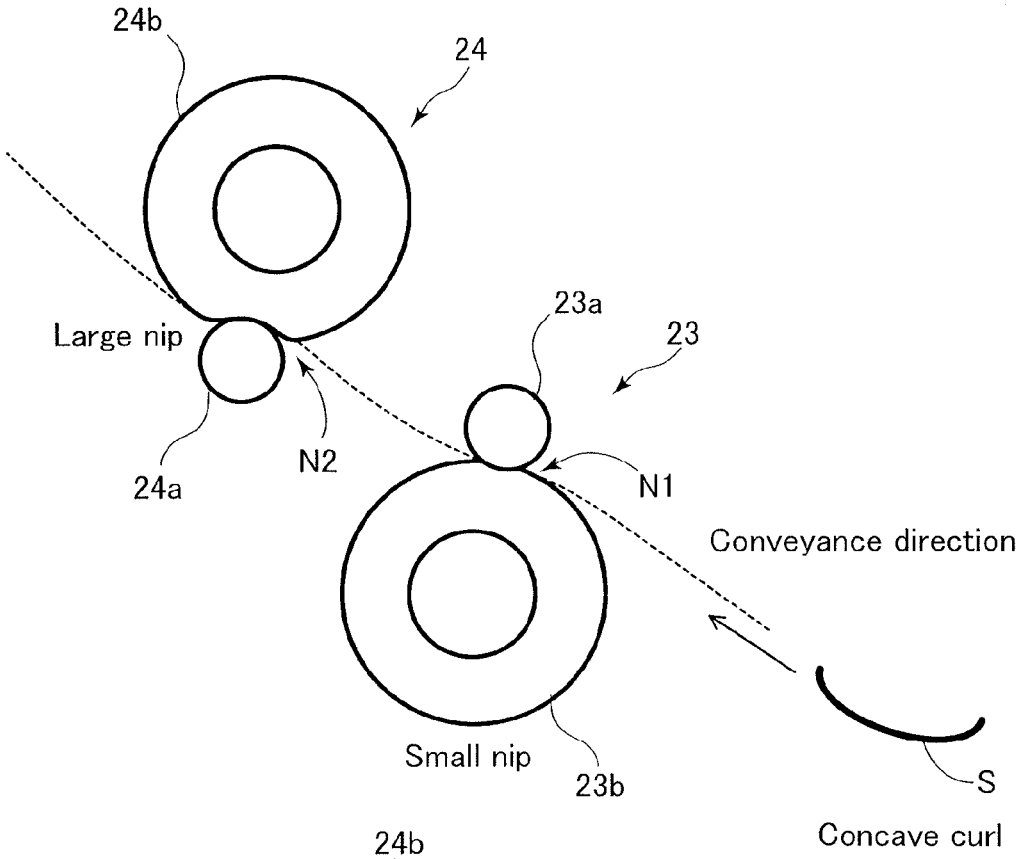
FIG. 5A is a view illustrating a state where the upstream curl correction roller pair and the downstream curl correction roller pair are correcting a concave shaped curl.
Figure 5B:
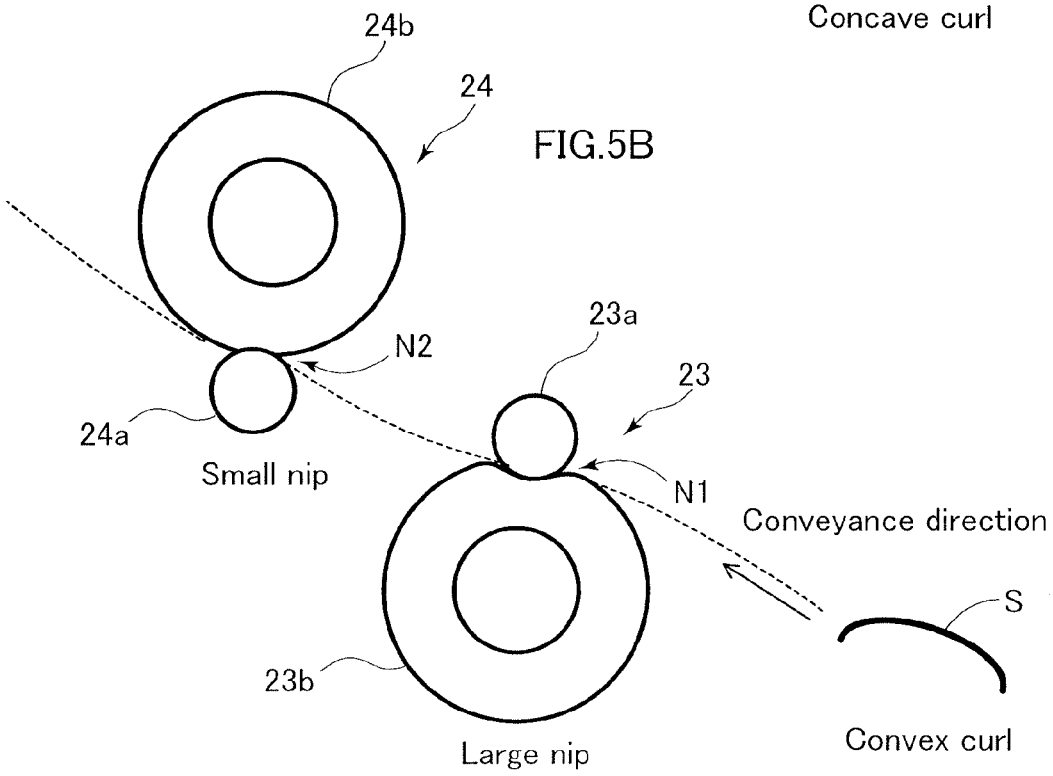
FIG. 5B is a view illustrating a state where the upstream curl correction roller pair and the downstream curl correction roller pair are correcting a convex shaped curl.

In the preferred embodiment of the present embodiment, when correcting a convex-shaped curl, the amount of curve of the nip portion N1 of the upstream curl correcting roller pair 23 is increased and the amount of curve of the nip portion N2 of the downstream curl correcting roller pair 24 is reduced, as shown in FIG. 5B. Further, when correcting a concave-shaped curl, the amount of curve of the nip portion N1 of the upstream curl correcting roller pair 23 is reduced and the amount of curve of the nip portion N2 of the downstream curl correcting roller pair 24 is increased, as shown in FIG. 5A.

The amount of curl of a sheet is varied according to various parameters, such as the temperature and humidity, the moisture content of the sheet, the sheet type, the sheet thickness, the image density, the amount of toner, and so on, and the amount of correction of the curl is determined according to the respective parameters. Then, based on the determined correction amount, the controller 120 changes the amount of penetration (pressing force) of the following rollers 23*b* and 24*b* with respect to the curl correcting rollers 23*a* and 24*a*, in other words, the shape of the nip portion, by the amount of rotation of the cam member described later.

Figure 6:
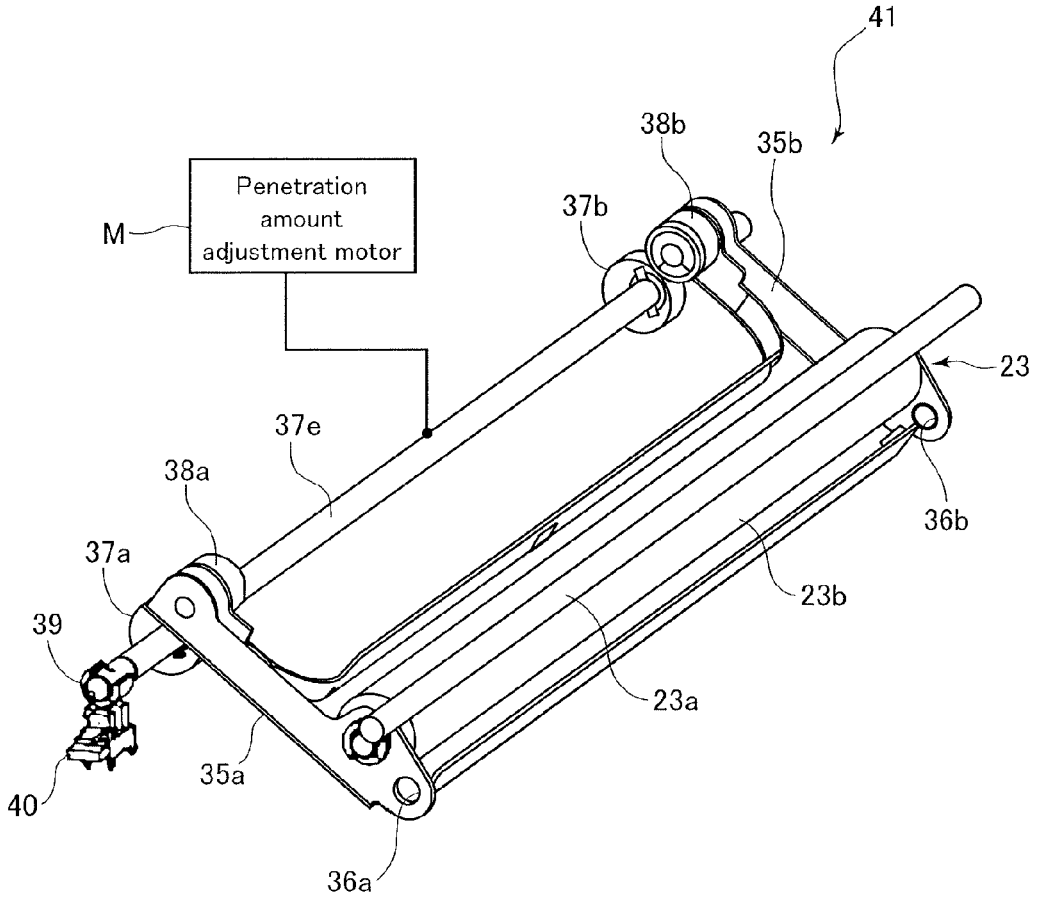
FIG. 6 is a perspective view illustrating a configuration of an upstream curl correcting portion.

Next, a mechanism for changing the amount of penetration (pressing force) of the following rollers 23*b* and 24*b* with respect to the curl correcting rollers 23*a* and 24*a* will be described with reference to FIG. 6. FIG. 6 illustrates the upstream curl correcting portion 41, but the downstream curl correcting portion 42 also has a similar configuration.

As shown in FIG. 6, the upstream curl correcting portion 41 is equipped with swing members 35*a* and 35*b*, a rotation shaft 37*e*, cam members 37*a* and 37*b*, an HP detection flag 39, and a photosensor 40. The swing members 35*a* and 35*b* hold the upstream following roller 23*b* as a rotating member in a rotatable manner, and swings around swing center portions 36*a* and 36*b* as fulcrums. Roller members 38*a* and 38*b* are disposed rotatably on the end of the swing members 35*a* and 35*b*.

Cam members 37*a* and 37*b* each having a non-fixed distance from the center of rotation to the outer circumference surface are respectively pressed against the roller members 38*a* and 38*b*. The cam members 37*a* and 37*b* are fixed to the rotation shaft 37*e* driven to rotate by a penetration amount adjustment motor M which is a drive unit capable of rotating in both normal and reverse directions. The HP detection flag 39 is fixed to one end of the rotation shaft 37*e*, and the controller 120 can detect the rotational position of the cam members 37*a* and 37*b* by the photosensor 40 detecting the HP detection flag 39.

Figure 7:
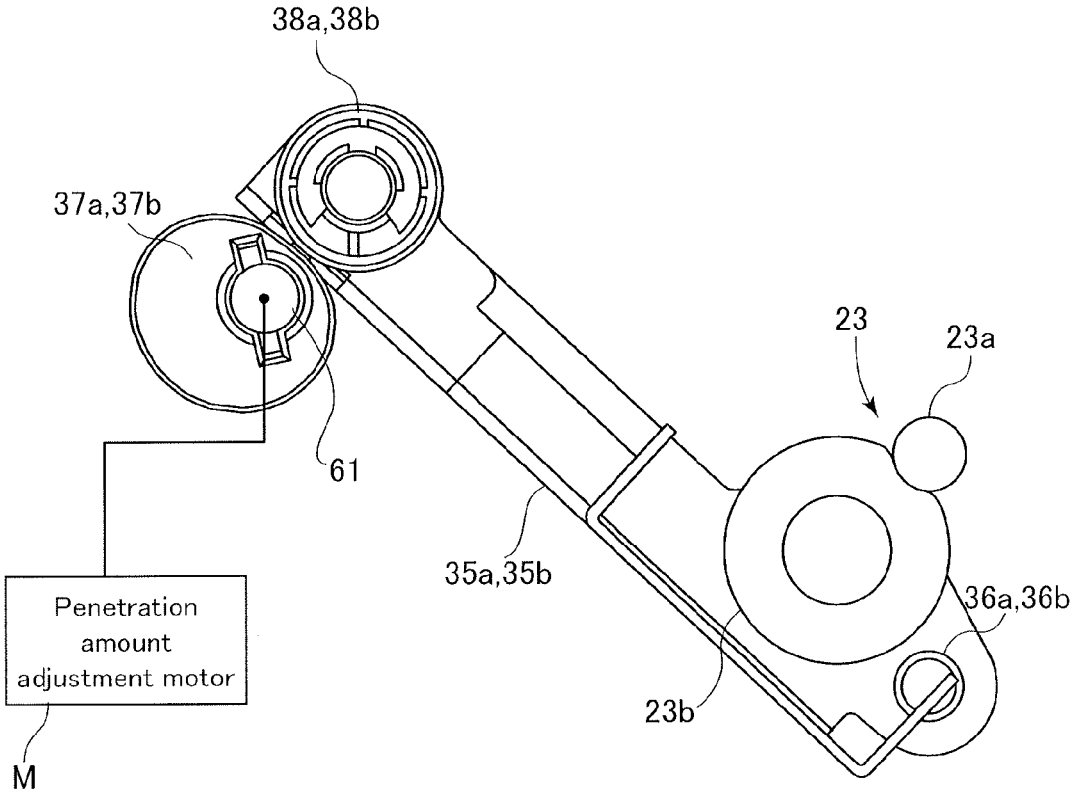
FIG. 7 is a side view showing an upstream curl correcting portion when a cam member is positioned at a bottom dead center.

Now, as shown in FIG. 7, the roller members 38*a* and 38*b* respectively retained by the swing members 35*a* and 35*b* constantly contact outer circumferential surfaces of the cam members 37*a* and 37*b* by the reaction force of the upstream following roller 23*b* pressed against the upstream curl correcting roller 23*a*, or by a pressure member not shown. Then, when the power source of the printer body 101 is turned on, for example, the controller 120 drives the penetration amount adjustment motor M to rotate the cam members 37*a* and 37*b*, so as to adjust the amount of penetration (pressing force) of the upstream following roller 23*b* with respect to the upstream curl correcting roller 23*a* according to the curl correction amount.

When rotating the cam members 37*a* and 37*b*, the controller 120 determines the rotation angle from a reference angle of the cam members 37*a* and 37*b*, according to the curl correction amount. Then, after detecting that the cam members 37*a* and 37*b* are at home position based on the signal from the photosensor 40, it drives the penetration amount adjustment motor M to rotate the cam members 37*a* and 37*b* for a given amount, and adjusts the amount of penetration (pressing force) of the upstream curl correcting roller pair 23 in multiple steps.

Figure 8:
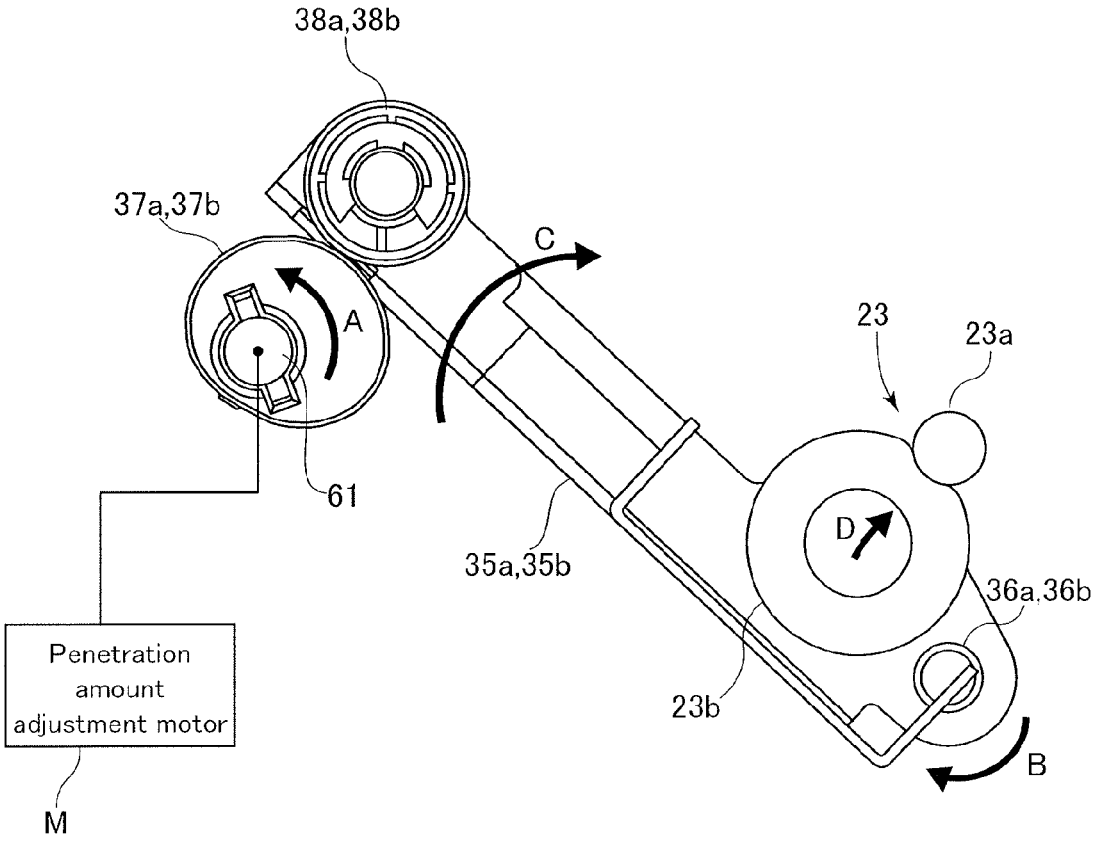
FIG. 8 is a side view showing an upstream curl correcting portion when the cam member is positioned at a top dead center.

Now, if the penetration amount adjustment motor M is driven and the cam members 37*a* and 37*b* are rotated in an arrow A direction, for example as shown in FIG. 8, the swing members 35*a* and 35*b* swing around the swing center portions 36*a* and 36*b* in directions of arrows B and C via roller members 38*a* and *b*, and along therewith, the upstream following roller 23*b* swings in an arrow D direction. Thereby, the upstream following roller 23*b* is pressed against the upstream curl correcting roller 23*a*, and the upstream curl correcting roller 23*a* is penetrated for a given amount to the upstream following roller 23*b*.

Figure 9:
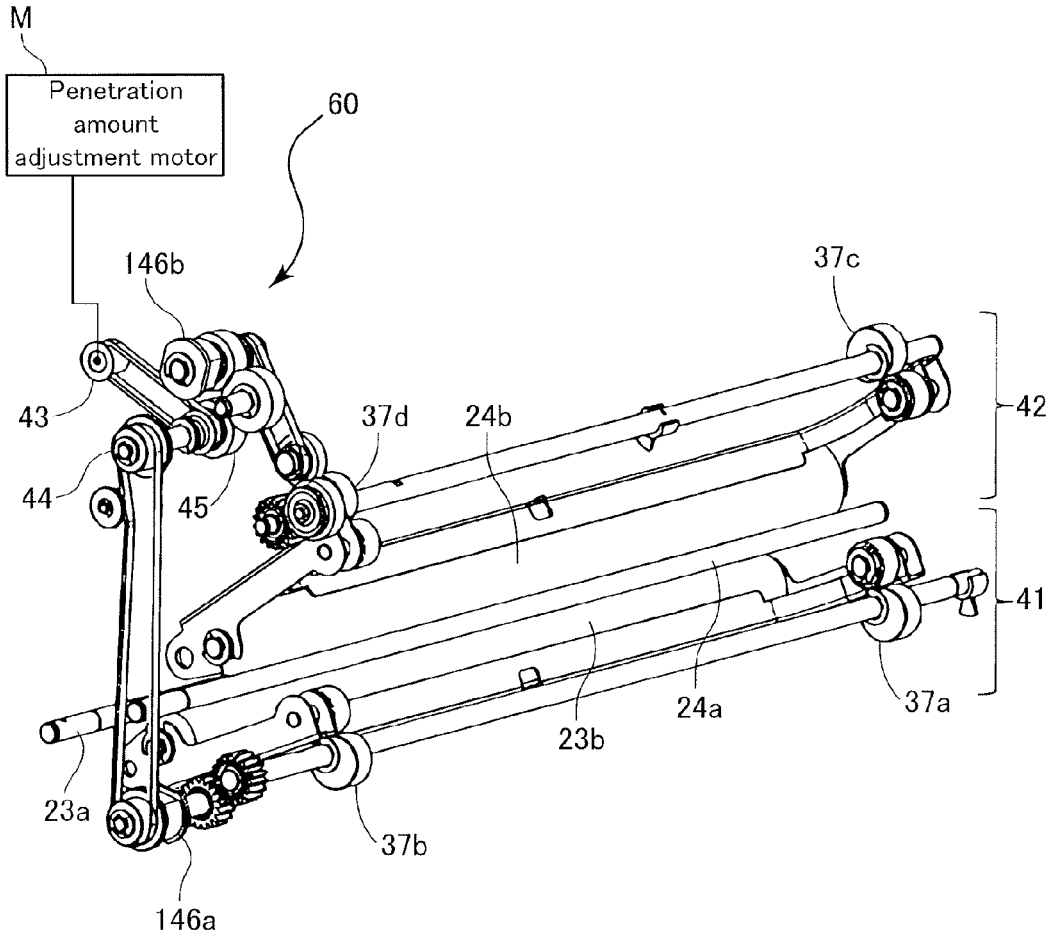
FIG. 9 is a perspective view showing a drive mechanism provided in the curl correcting apparatus.

Next, a drive mechanism 60 of the curl correcting apparatus 20 according to the present embodiment will be described with reference to FIG. 9. As shown in FIG. 9, the drive mechanism 60 is equipped with a penetration amount adjustment motor gear 43, an upstream one-way pulley 44 which is a pulley to which a one-way clutch is press-fit, a downstream one-way gear 45 which is a gear to which a one-way clutch is press-fit, an upstream bearing 146*a*, and a downstream bearing 146*b*. The upstream one-way pulley 44 is arranged along a transmission path through which the driving force of the penetration amount adjustment motor M is transmitted to the cam members 37*a* and 37*b*. The downstream one-way gear 45 is arranged along a transmission path through which the driving force of the penetration amount adjustment motor M is transmitted to the cam members 37*c* and 37*d*.

The driving force entered from the penetration amount adjustment motor M is transmitted to each drive unit through the penetration amount adjustment motor gear 43. That is, when the penetration amount adjustment motor M is rotated in a second rotating direction, such as in normal rotation, a normal rotation driving force of the penetration amount adjustment motor M is transmitted via the upstream one-way pulley 44 as a second transmission portion to the cam members (upstream cam members) 37*a* and 37*b* of the upstream curl correcting portion 41.

Further, if the penetration amount adjustment motor M is rotated in a first rotating direction that is opposite to the second rotating direction, for example, in reverse rotation, a reverse rotation driving force of the penetration amount adjustment motor M is transmitted via the downstream one-way gear 45 as first transmission portion to the cam members 37*c* and 37*d* of the downstream curl correcting portion 42.

Here, during normal rotation of the penetration amount adjustment motor M, the downstream one-way gear 45 is rotated idly, and driving force to the downstream curl correcting portion 42 is cut off. When driving the penetration amount adjustment motor M in reverse rotation, the upstream one-way pulley 44 is rotated idly, and driving force to the upstream curl correcting portion 41 is cut off. As described, according to the present embodiment, the upstream curl correcting portion 41 and the downstream curl correcting portion 42 can be driven independently by using the normal and reverse rotations of the penetration amount adjustment motor M.

In the areas on the upward slope side of the cam members 37*a* and 37*b* that change the amount of penetration (pressing force) of the upstream curl correcting roller pair 23, a force in the direction opposite to the direction of rotation acts on the cam members 37*a* and 37*b*. In contrast, when the cam members 37*a* and 37*b* exceed the top dead center and rotate toward the bottom dead center, that is, in the areas on the downward slope side of the cam members 37*a* and 37*b*, a force in the same direction as the direction of rotation acts on the cam members 37*a* and 37*b*. When the cam members 37*a* and 37*b* are positioned at the top dead center, as shown in FIG. 8, the swing members 35*a* and 35*b* are positioned at the uppermost position, and the nipping pressure of the upstream curl correcting roller pair 23 is maximized.

Figure 10:
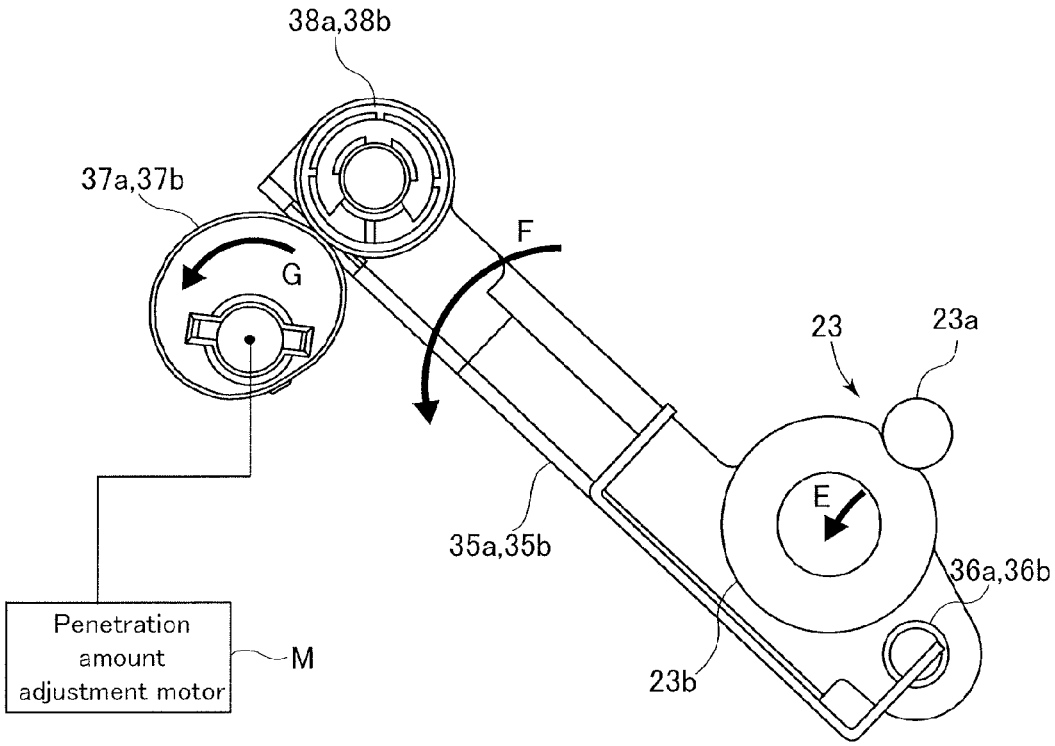
FIG. 10 is a side view showing a relationship of force in an area on a downward slope side of the cam member provided in the drive mechanism.

When the cam members 37*a* and 37*b* are positioned at the bottom dead center, as shown in FIG. 7, the swing members 35*a* and 35*b* are positioned at the lowermost position, and the nipping pressure of the upstream curl correcting roller pair 23 is minimized. The cam members 37*c* and 37*d* on the downstream curl correcting roller pair 24 side are configured similarly. FIG. 10 is a view showing a relationship of force in the downward slope-side area of the cam members 37*a* and 37*b*, and in the downward slope-side area of the cam members 37*a* and 37*b*, a rotation moment acts in an arrow F direction on the swing members 35*a* and 35*b* by a reaction force (restoring force of upstream following roller 23*b*) E with respect to the pressing force of the upstream following roller 23*b*.

As a result, rotation moment Mg also acts on the cam members 37*a* and 37*b* in a direction shown by arrow G, which is the same direction as the direction of rotation by the penetration amount adjustment motor M. When the rotation speed of the cam members 37*a* and 37*b* exceeds the rotation speed of the motor by the rotation moment Mg, the position of the upstream following roller 23*b* may be displaced from the determined position.

As shown in the following expression (1), the rotation moment Mg is calculated based on a rotation angle of the cam members 37*a* and 37*b* (θc), an abutting angle of the roller members 38*a* and 38*b* (θk), a cam height of the cam members 37*a* and 37*b* (Zc), and a rotation moment Mp. The rotation moment Mp is a rotation moment in a direction of arrow F in the drawing acting on the swing members 35*a* and 35*b* by the reaction force E corresponding to the pressing force of the upstream following roller 23*b*.

$$Mg=F(\theta c,\ Zc,\ \theta k,\ Mp) \tag{1}$$

Figure 11:
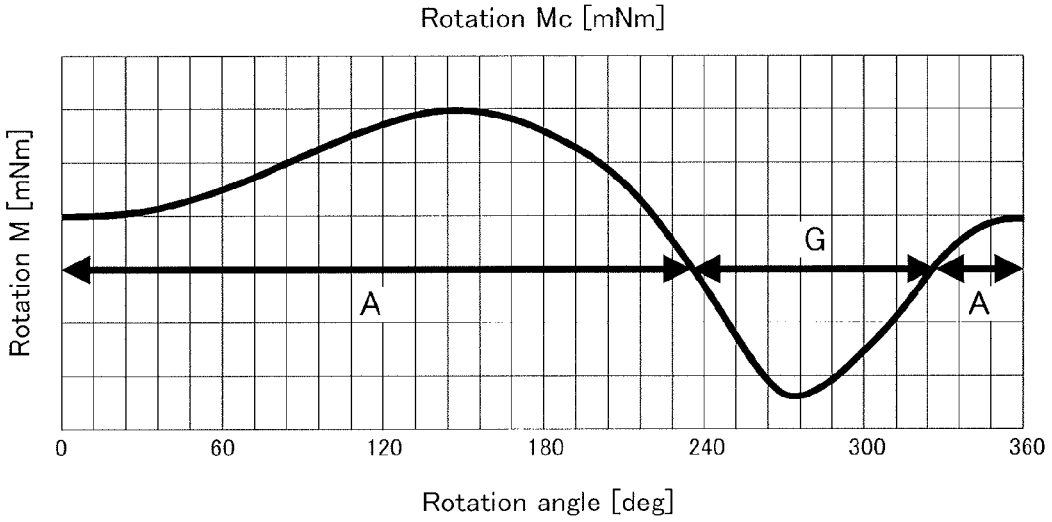
FIG. 11 is a view showing a relationship between a rotation angle of the cam member and a rotation moment acting on the cam member.

FIG. 11 is a view showing a relationship between a rotation angle of the cam members 37*a* and 37*b* and a rotation moment acting on the cam members 37*a* and 37*b*. A rotation moment in a direction opposite to the direction of rotation of the penetration amount adjustment motor occurs to the cam members 37*a* and 37*b* within section A in the drawing, and a rotation moment in the same direction as the direction of rotation of the penetration amount adjustment motor occurs within section G in the drawing. Section G is a predetermined range when the cam members 37*a* and 37*b* are positioned downstream than the top dead center and upstream than the bottom dead center. By the rotation moment Mg occurring in section G in the drawing, the rotation speed of the cam members 37*a* and 37 exceed the rotation speed of the motor.

Figure 12:
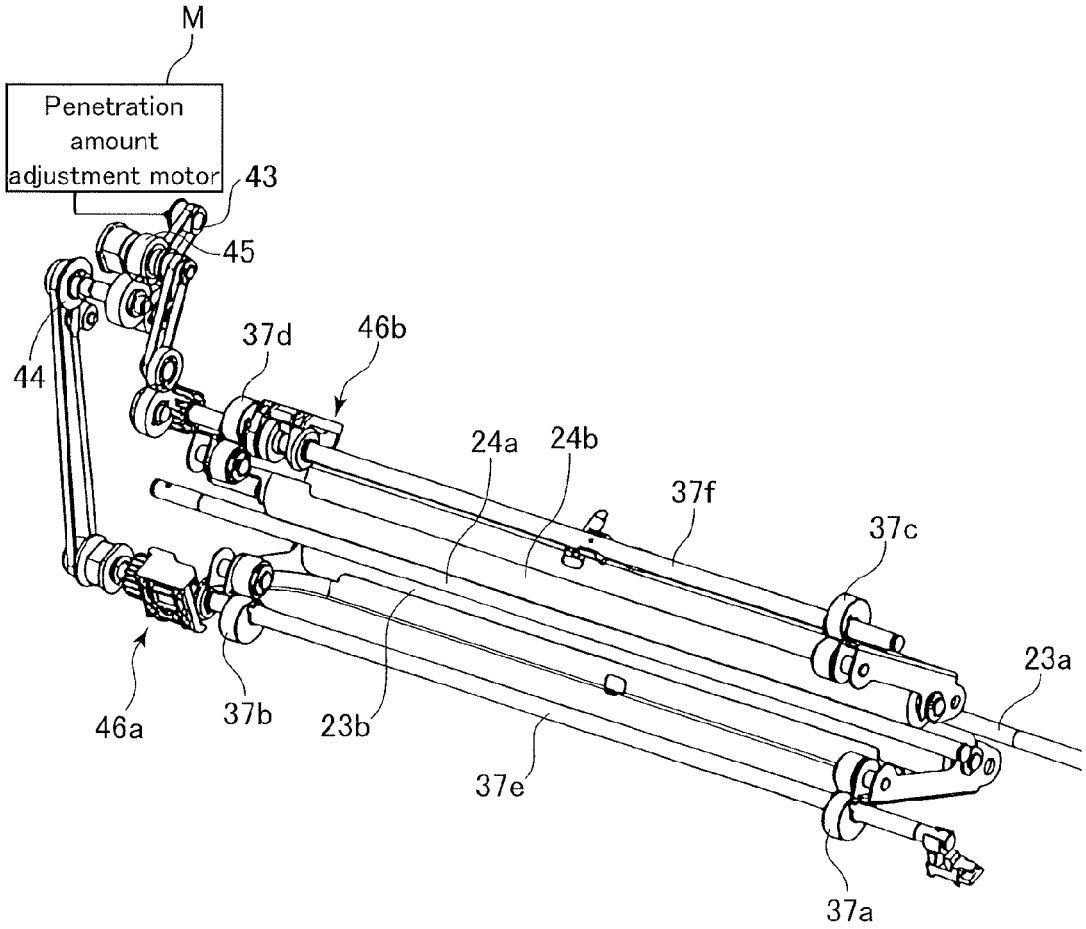
FIG. 12 is a perspective view illustrating a brake portion disposed in the curl correcting apparatus.

In the preferred embodiment of the present invention, a brake portion 46*a* is provided as an upstream load portion placing load on the rotation of the cam members 37*a* and 37*b* to the rotation shaft 37*e* of the cam members 37*a* and 37*b*, as shown in FIG. 12, so as to regulate the rotation of the cam members 37*a* and 37*b* in section G and prevent increase of rotation speed of the cam members 37*a* and 37*b*. Further, a brake portion 46*b* as a load portion is provided to a rotation shaft 37*f* of cam members 37*c* and 37*d*. By providing the brake portions 46*a* and 46*b*, an arrangement is adopted where regulating force acts on the cam members 37*a* and 37*b* from the axial direction in section G shown in FIG. 11.

Figure 13:
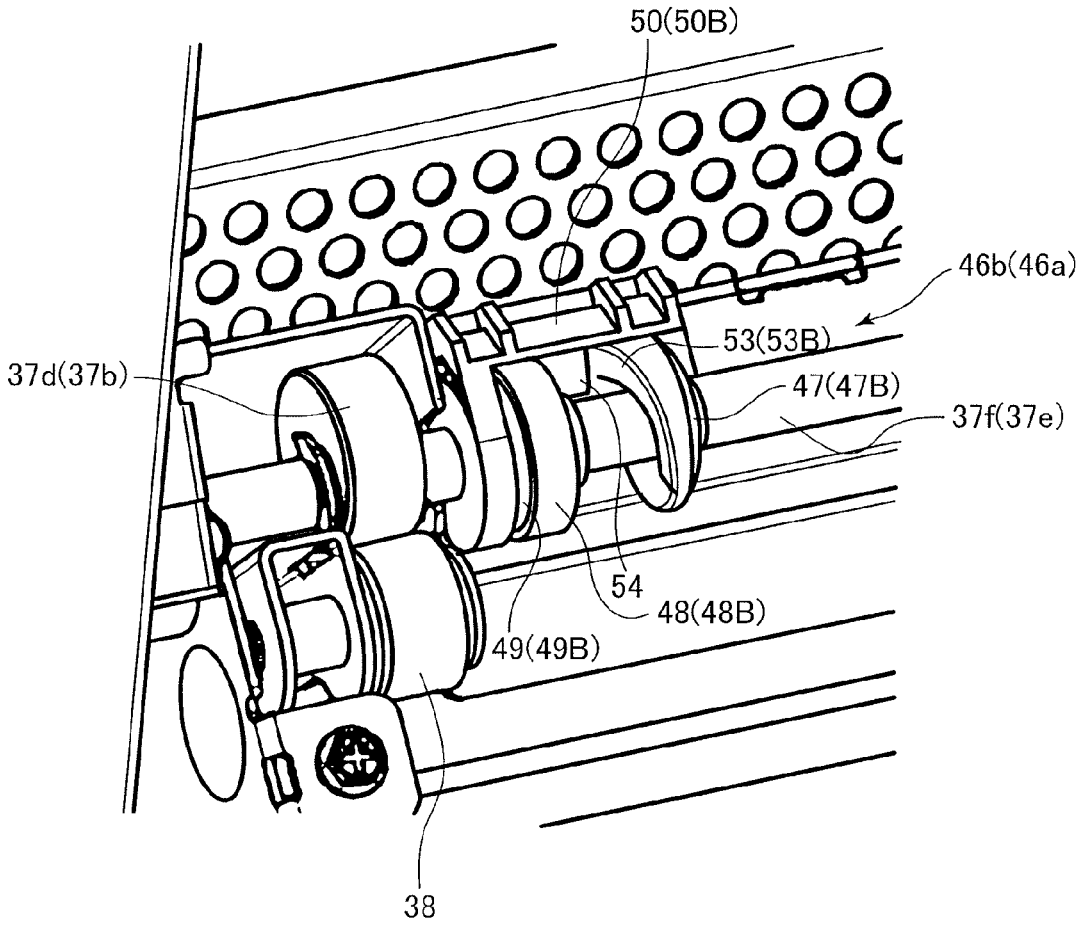
FIG. 13 is an enlarged perspective view showing the brake portion.
Figure 14A:
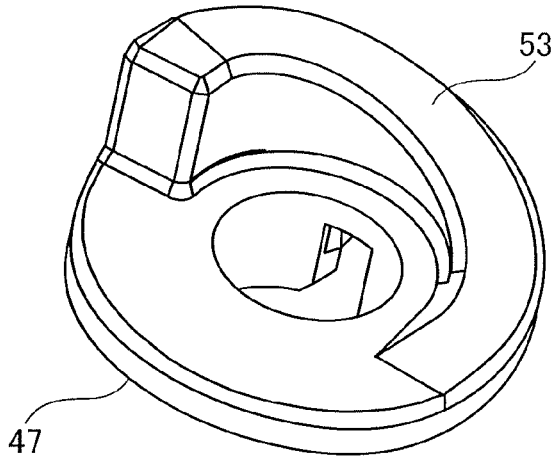
FIG. 14A is a perspective view illustrating a brake cam constituting the brake portion.

FIG. 13 is a drawing illustrating a configuration of the brake portion 46*b*. The brake portion 46*a* adopts a similar configuration. The brake portion 46*b* is equipped with, as shown in FIG. 13, a brake cam 47 as contact member, a brake block 48 as abutment member, and a brake retention member 50 as retention member fixed to a frame of the curl correcting apparatus 20 not shown. The brake cam 47 is fixed to the rotation shaft 37*f* of the cam members 37*c* and 37*d*, rotated integrally at a same speed as the cam members 37*c* and 37*d*, and has a cam surface 53 formed on one side surface in the axial direction, as shown in FIG. 14A. The cam surface 53 is an inclined plane inclined toward the axial direction along the direction of rotation.

Figure 14B:
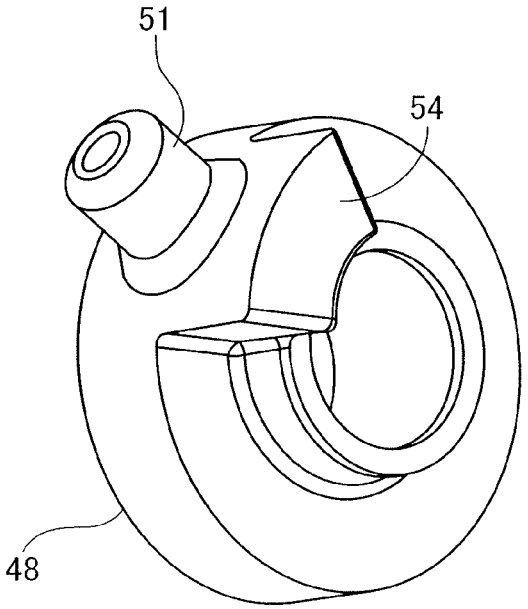
FIG. 14B is a perspective view illustrating a brake block constituting the brake portion.

Further, the brake block 48 as an abutment member is disposed movably in the axial direction on the rotation shaft 37*f*, and as shown in FIG. 14B, is equipped with an abutment portion 54 (projection) projected toward the cam surface 53 and abutted against the cam surface 53, and a rotation support portion 51. Then, by having the cam surface 53 pressed against the abutment portion 54 of the brake block 48, the brake cam 47 can cause brake force (regulating force) to occur to the rotation shaft 37*f*.

Figure 15A:
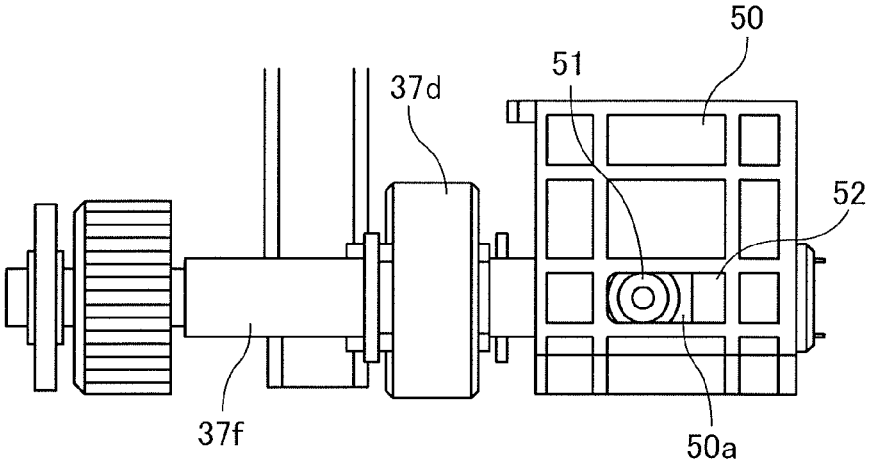
FIG. 15A is a plan view showing a state where an abutment portion of the brake block is pressed against the cam surface.
Figure 15B:
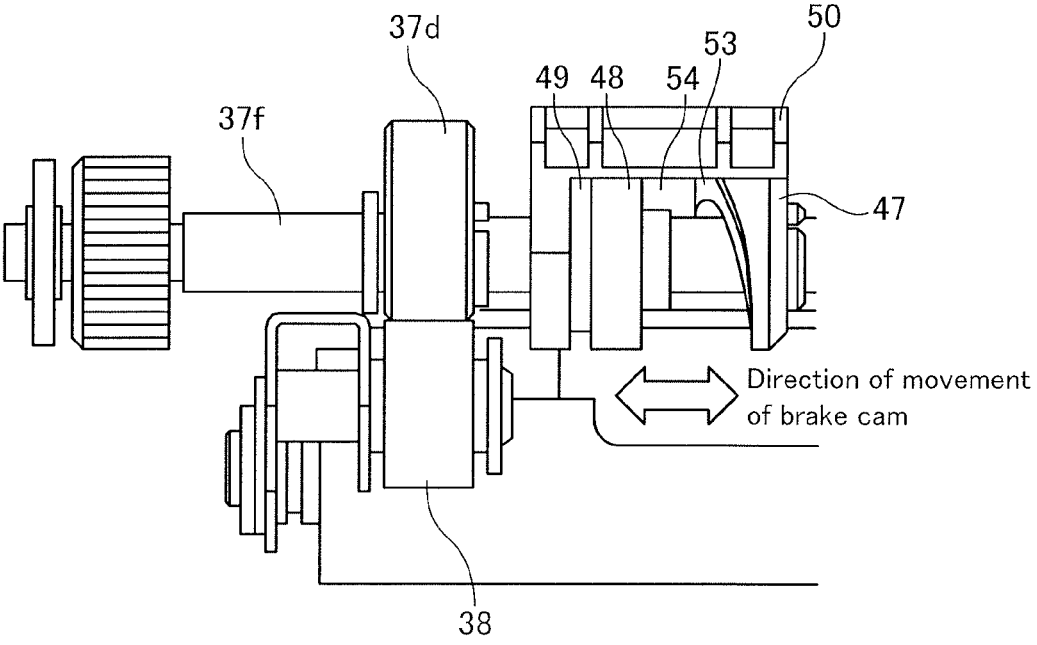
FIG. 15B is a side view showing a state where an abutment portion of the brake block is pressed against the cam surface.

As shown in FIG. 15A, the rotation support portion 51 of the brake block 48 is engaged with a guide portion 50*a* disposed along an axial direction on the brake retention member 50. Thereby, the brake block 48 moves along the rotation shaft 37*f* by the guide portion 50*a* of the brake retention member 50 while having its axial rotation regulated. Further, as shown in FIG. 15B, the brake block is pressed toward the brake cam 47 by a brake spring 49 as biasing member. The brake retention member 50 supports the brake spring 49 with the brake block 48. Thereby, when the brake cam 47 rotates in the counterclockwise direction together with the cam members 37*c* and 37*d*, the cam surface 53 of the brake cam 47 presses the abutment portion 54, and the brake block 48 moves in a left direction in the drawing, opposing to the spring force (biasing force) of the brake spring 49.

At this time, the reaction force of the brake spring 49 acts as brake force on the rotation shaft 37*f* through the brake cam 47. In other words, the cam surface 53 converts the biasing force in the axial direction from the brake spring 49 to a force in a direction opposite to the direction of rotation of the cam members 37*c* and 37*d* rotated by the penetration amount adjustment motor M.

Figure 16A:
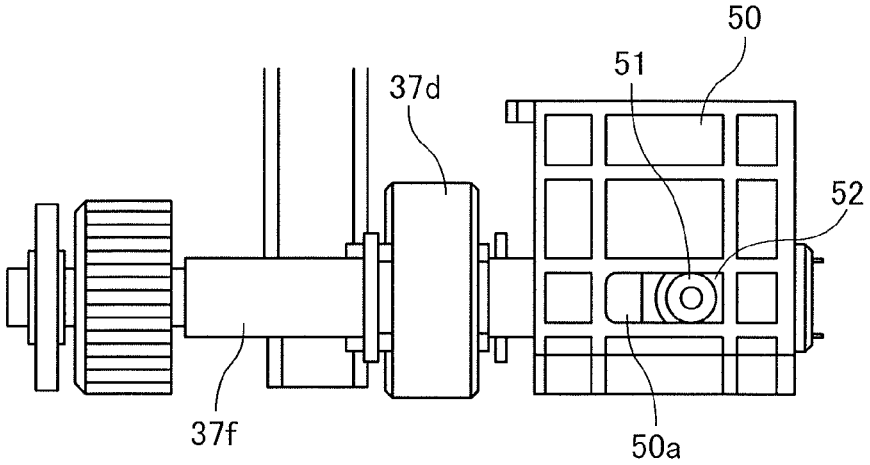
FIG. 16A is a plan view showing the state where the abutment portion of the brake block is separated from the cam surface.
Figure 16B:
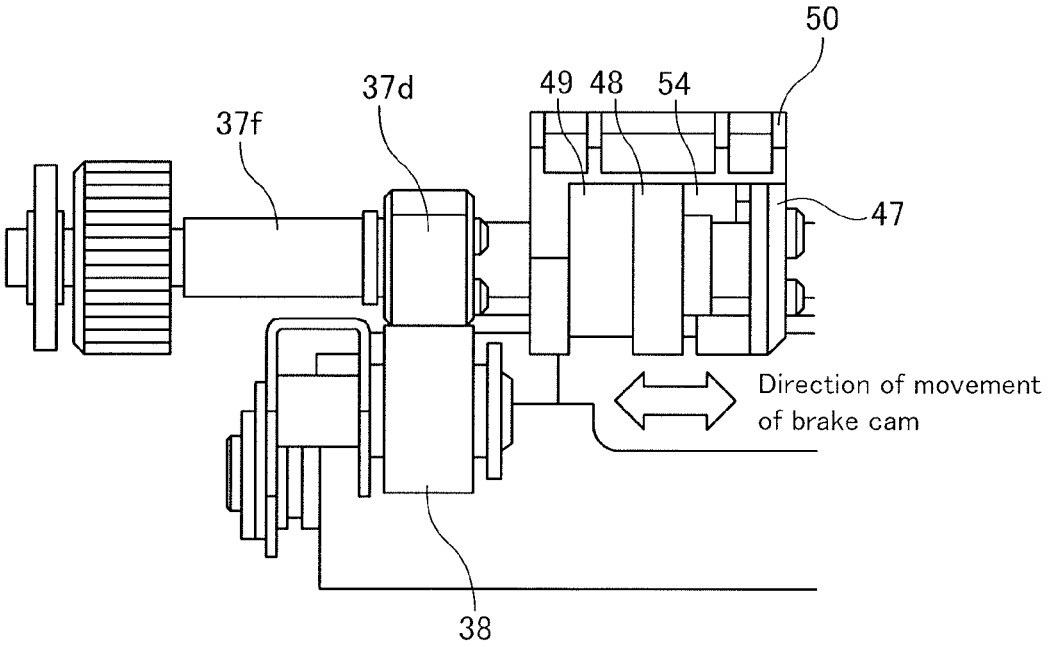
FIG. 16B is a side view showing the state where the abutment portion of the brake block is separated from the cam surface.

The cam surface 53 is formed to correspond to section G illustrated in FIG. 11 described previously, so that in section A illustrated in FIG. 11, the brake force will not act even when the cam members are rotated. While the brake force is not active, the position of the brake block 48 is determined by the rotation support portion 51 being butted against the right end of the guide portion 50*a* of the brake retention member 50, as shown in FIGS. 16A and 16B.

The brake portion 46*a* has a similar configuration as the brake portion 46*b*, and as shown in FIG. 13, it is equipped with a brake cam 47B as upstream contact member, a brake block 48B as upstream abutment member, a brake spring 49B as upstream biasing member, and a brake retention member 50B supporting the brake spring 49B with the brake block 48B. Further, a cam surface 53B as an upstream cam surface is formed on one side surface in the axial direction of the brake cam 47B.

According to this arrangement, in the state where the rotation support portion 51 is abutted against the guide portion 50*a* of the brake retention member 50, the brake cam 47 and the brake block 48 are in a non-contact state, and therefore, no extra force is applied on the rotation force of the cam members 37*c* and 37*d*. That is, when the cam members 37*c* and 37*d* are positioned upstream than the bottom dead center and upstream than the top dead center in the direction of rotation, the abutment portion 54 of the brake block 48 is separated from the brake cam 47. Further, an elastic member 52 is provided to the guide portion 50*a*, for example, so that collision noise will not occur when the rotation support portion 51 abuts against the right end of the guide portion 50*a*.

Figure 17A:
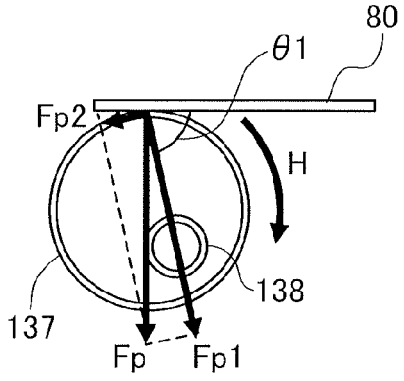
FIG. 17A is a view illustrating a brake force in an upward slope of the cam member in a prior art brake configuration.
Figure 17B:
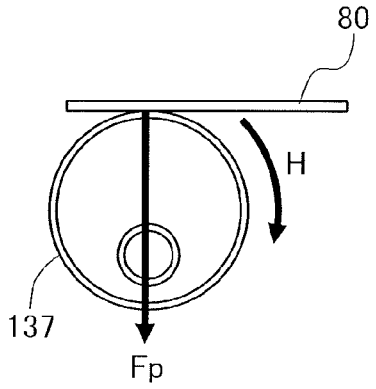
FIG. 17B is a view illustrating a brake force when the cam member is at a top dead center according to the prior art brake configuration.

Now, FIGS. 17A through 18C are referred to in describing the brake force of a brake configuration according to a comparative example and a brake force (regulating force) according to the present embodiment. FIGS. 17A through 17C illustrate a change of brake force of a brake configuration according to a comparative example, wherein FIG. 17A illustrates a state where the cam 137 contacts a pushing member 80 at an upward slope. FIG. 17B illustrates a state where the cam 137 contacts the pushing member 80 at the top dead center, and FIG. 17C illustrates a state where the cam 137 contacts the pushing member 80 at the downward slope. The pushing member 80 is supported swingably around an axis not shown, and biased toward the cam 137. Now, by denoting the brake force (regulating force) as Fb, the pressing force of the pushing member 80 to the cam 137 as Fp and a coefficient of friction between the pushing member 80 and the cam 137 as μc, the brake force (regulating force) Fb can be represented by the following expression (2).

$$Fb=Fp1\cdot\mu c+Fp2 \tag{2}$$

Component Fp1 and component Fp2 are components in the direction of normal vector and the direction of tangential line of a pressing force Fp at a point of contact between the pushing member 80 and the cam 137. At this time, according to the brake configuration of the comparative example, there is a large contact angle θ1 between the pushing member 80 and a center of rotation of the cam 137. Therefore, the component Fp2 for converting the pressing force Fp of the pushing member 80 to brake force (regulating force) is small. Here, in order to realize a large component Fp2, the cam 137 or the pushing member 80 must be increased in size, which is a hindrance to downsizing the apparatus.

Figure 17C:
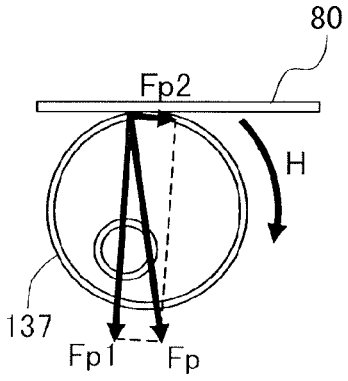
FIG. 17C is a view illustrating a brake force in a downward slope of the cam member in the prior art brake configuration.

When the component (Fp2) in the tangential line direction becomes greater than a friction force (Fp1·μc), as shown in FIG. 17C, the component Fp2 will not act as brake force (regulating force). When the friction force of the cam 137 and the pushing member 80 is increased so that the friction force (Fp1·μc) is constantly greater than the component Fp2, the brake will necessarily depend on the friction force. In that case, the brake force may be varied by the chipping of the pushing member 80 or the deterioration of surface durability, or noise may occur by the change in sliding performance or friction force between the cam 137 and the pushing member 80. Along with the recent advancement in elongation of life and reduction of noise, there is a demand for a small brake mechanism capable of realizing a large regulating force, without depending greatly on friction force.

Figure 18A:
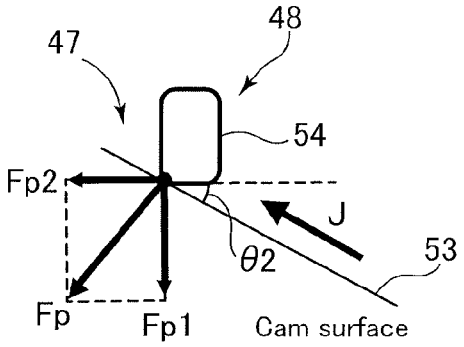
FIG. 18A is a view illustrating a brake force of a brake portion according to the present embodiment.
Figure 18B:
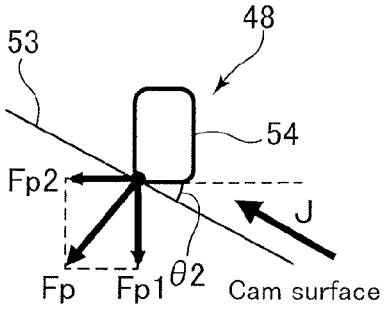
FIG. 18B is a view illustrating a brake force of a brake portion when the cam member is rotated to a position downstream than the position illustrated in FIG. 18A.
Figure 18C:
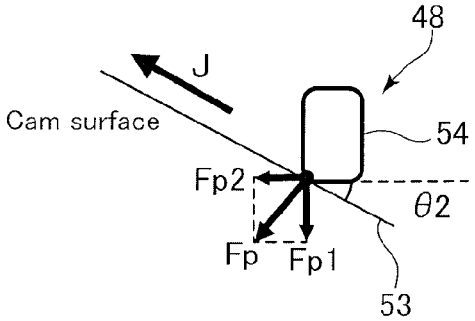
FIG. 18C is a view illustrating a brake force of the brake portion when the cam member is rotated to a position downstream than the position illustrated in FIG. 18B.

In contrast, according to the present embodiment, brake force (regulating force) is obtained on the rotation shaft 37*f* of the cam members 37*c* and 37*d* by having the cam surface 53 of the brake cam 47 and the abutment portion 54 of the brake block 48 pressed against one another, as mentioned earlier. According to this configuration, the change of brake force (regulating force) of the brake configuration according to the present embodiment, together with the movement of the cam surface 53, will be as shown in FIGS. 18A through 18C.

In other words, according to the brake configuration of the present embodiment, an abutting angle θ2 between the abutment portion 54 of the brake block 48 and the cam surface 53 of the brake cam 47 can be set freely regardless of the rotation angle of the cam member 37, by changing the shape of the cam surface 53. According to the present embodiment, the cam surface 53 is abutted at an abutting angle θ2 that is always smaller than the abutting angle θ1 of the comparative example shown in FIG. 17A, regardless of the rotation angle of the cam member 37. Then, by reducing the abutting angle θ2 as described, the component Fp2 for converting the pressing force Fp by the abutment portion 54 of the brake block 48 to a brake force (regulating force) is increased.

As a result, the pressing force of the pushing member itself can be reduced without depending on the friction force, so that an efficient brake configuration can be realized. Further, along with the rotation of the brake cam 47, as long as the cam surface is a straight inclined plane, even if the relative positions of the cam surface and the pushing member are displaced, the abutting angle θ2 of the cam surface 53 and the abutment portion 54 become constant, and Fp2 can constantly acquire a fixed brake force (regulating force) in the same direction.

As described, according to the present embodiment, regulating force is applied from the axial direction to the brake portions 46*a* and 46*b* with respect to the cam members 37*a*, 37*b*, 37*c* and 37*d* so that the cam members 37*a*, 37*b*, 37*c* and 37*d* are not rotated via a rotation speed faster than the rotation speed rotated by the penetration amount adjustment motor M. Thereby, the brake configuration does not depend greatly on the friction force, and the brake force (friction force) is not easily changed by the chipping or deterioration of durability, so that the rotation of the cam members 37*a*, 37*b*, 37*c* and 37*d*, having multiple angle adjustment positions and guarantee of cam angle thereof is important, can be regulated stably. Furthermore, the present embodiment enables to prevent drastic increase of load and occurrence of noise caused by the change of surface property or friction force, so that a brake configuration having a long life and superior noise reduction performance can be obtained.

Further, the brake cam 47, the brake block 48 and the like constituting the brake portions 46*a* and 46*b* can be arranged along the direction of the rotation shaft of the cam member 37, so that the arrangement can be downsized compared to the configuration where a brake is applied from the outer side of the cam members 37*a*, 37*b*, 37*c* and 37*d*. In the case of the curl correcting apparatus 20 designed to generate a greater nip pressure using the cam members 37*a*, 37*b*, 37*c* and 37*d* compared to a normal conveyance roller pair, the reaction force acting on the cam members 37*a*, 37*b*, 37*c* and 37*d* is also great, and a high regulating force is required to be applied on a large area in response, so that the effect of the present arrangement is especially effective.

Incidentally, in the above description, the normal and reverse rotations of the penetration amount adjustment motor M are respectively transmitted to the upstream curl correcting portion 41 and the downstream curl correcting portion 42, but the present invention is not restricted to such example. For example, it is possible to use one rotation drive of the penetration amount adjustment motor M for adjusting the position of the roller pair for correcting curls, and to transmit the other rotation drive to a totally different load or mechanism. Moreover, the present invention is not restricted to being applied to the curl correcting apparatus 20, and can be applied to a configuration having a drive unit capable of transmitting and cutting a driving force, and can change the relative position of one roller and the other roller constituting a roller pair by driving a cam member.

According to the above description, an upstream one-way pulley 44 and a downstream one-way gear 45 have been used as transmission means for transmitting or cutting off the driving force during normal and reverse rotations of the penetration amount adjustment motor M, but the present invention is not restricted to such example. For example, it is also possible to adopt a configuration where the drive transmission paths during normal and reverse rotations of the motor are changed by swinging a swing gear as transmission means, or the drive transmission paths are changed using an actuator such as an electromagnetic clutch or a solenoid.

In the above description, the cam member, the brake cam and the brake block have been described as separate members, but the present invention is not restricted to such example. For example, it is possible to provide the cam surface 53 of the brake cam 47 on the side surfaces of the cam members 37*c* and 37*d* to realize an integrated structure, or to provide the abutment portion 54 of the brake block on the side surfaces of the cam members 37*c* and 37*d* to realize an integrated structure. In other words, it is possible to provide either the brake cam 47 or the brake block 48 to the side surfaces of the cam members 37*c* and 37*d*, and to provide the other one of the members movably along the axis of the cam member 37 in the state where rotation is regulated.

According further to the preferred embodiment of the present embodiment, a configuration is adopted where the brake cam 47 rotates together with the cam members 37*c* and 37*d*, and the brake block 48 has a non-rotating configuration where rotation is regulated, but the present invention is not restricted thereto. For example, it is possible to adopt a configuration where the brake cam 47 is formed as a non-rotating member where rotation is regulated, while the cam members 37*c* and 37*d* are formed movably along the rotation shaft 37*f*, wherein the brake block 48 is formed to rotate together with the cam members 37*c* and 37*d*. In other words, it is possible to have one of the brake cam 47 and the brake block 48 to rotate integrally with the rotation shaft 37*f* of the cam members 37*c* and 37*d*, and to have the other one disposed movably along the axis of the cam member 37 in the state where rotation is regulated.

Moreover, a compression spring has been described as an example of the brake spring 49 being a biasing member applying pressing force to the cam surface 53 of the brake cam 47, but other biasing members, such as a tension spring, a disc spring, a leaf spring or a magnet, can also be used.

Figure 19:
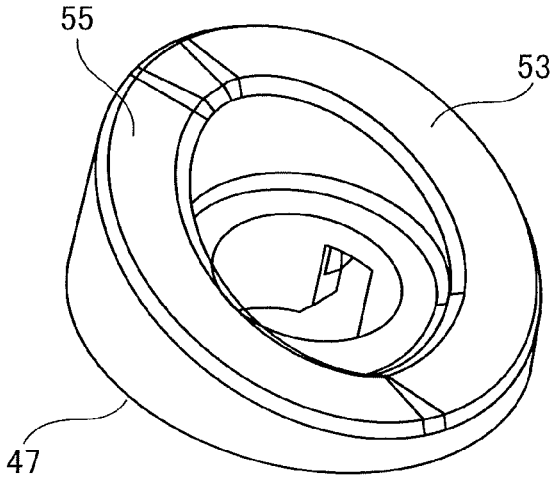
FIG. 19 is a perspective view illustrating a different configuration of the brake cam.

Further, the brake portions 46*a* and 46*b* according to the present invention not only apply regulating force, but also enable to apply an assisting force (auxiliary force) in the direction of rotation at an arbitrary rotation angle of the cam members 37*c* and 37*d*. For example, as shown in FIG. 19, an assist cam surface 55 being a different cam surface slanted in a direction opposite from the cam surface 53 and being pressed against the abutment portion of the brake block 48 after the cam surface 53 has passed through can be provided on the brake cam 47.

When the assist cam surface 55 is provided as described, in a state where the cam members 37*c* and 37*d* are rotated in a rotation speed rotated by the penetration amount adjustment motor M, the assist cam surface 55 is pressed by the brake spring 49 in compressed state, and is pressed against the abutment portion 54 of the brake block 48. Thereby, when the cam members 37*c* and 37*d* rotate in a direction increasing the nip pressure of the downstream curl correcting roller pair 24, the biasing force of the brake spring 49 can be set as the assisting force (auxiliary force), and the load of the penetration amount adjustment motor M can be reduced.

Figure 20:
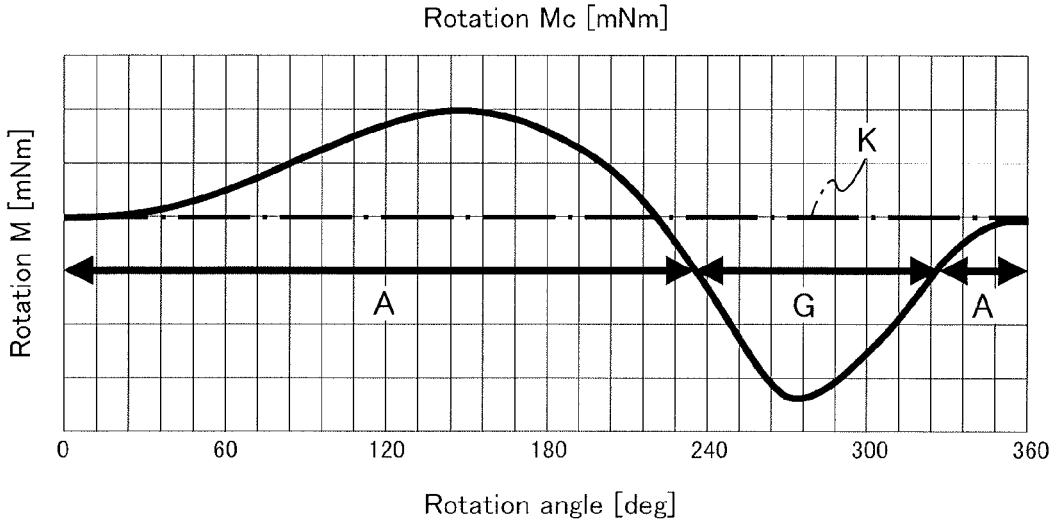
FIG. 20 is a view illustrating a rotation force acting on the cam member when the brake cam having the above-illustrated different configuration is used.

Moreover, by designing the cam surface 53 and the assist cam surface 55 to be a non-straight shape or a non-linear shape, the regulating force and the assisting force (auxiliary force) can be controlled in response to the rotation moment regarding the respective angles of the cam members 37*a*, 37*b*, 37*c* and 37*d* illustrated in FIG. 11. For example, even when a large reaction force is applied on the cam members 37*a*, 37*b*, 37*c* and 37*d*, as illustrated by a dashed-dotted line K of FIG. 20, the force can be turned into a fixed rotation moment by the regulating force by the cam surface 53 and the assisting force (auxiliary force) by the assist cam surface 55. As a result, the penetration amount adjustment motor M can be further downsized, and saving of power, space and costs can be realized.

In this embodiment, curl correction roller pairs 23 and 24 are illustrated as rotator pairs for correcting a curling. This invention can be also applied to a rotating belt and a rotating roller that correct a curling of a sheet while nipping and conveying a sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-208312, filed Oct. 9, 2014, which is hereby incorporated by reference herein in its entirety.

What is claimed is:

1. A sheet conveyance apparatus comprising:

a first rotator;

a second rotator configured to convey a sheet together with the first rotator;

a cam member configured to change a position of the second rotator with respect to the first rotator;

a drive unit configured to rotate the cam member; and a load portion configured to apply load on a rotation of the cam member, the load portion including:

a contact member having a cam surface formed on a side surface intersecting a line extending in an axial direction of the cam member;

an abutment member capable of abutting against the cam surface; and a biasing member configured to bias one of the contact member and the abutment member toward the other in the axial direction such that the cam surface of the contact member and the abutment member come into contact each other, wherein a biasing force of the biasing member in the axial direction is converted into a force in a direction opposing a rotating direction in which the cam member is driven by the drive unit by contact between the cam surface and the abutment member.

2. The sheet conveyance apparatus according to claim 1, wherein the abutment member has a projection protruded toward the cam surface, and the cam surface is configured to press the projection resisting against a biasing force of the biasing member in a given range where the cam member is positioned downstream more than a top dead center and upstream more than a bottom dead center in the direction of rotation.

3. The sheet conveyance apparatus according to claim 1, wherein the cam surface is an inclined plane inclined in the axial direction along the direction of rotation.

4. The sheet conveyance apparatus according to claim 1, further comprising a rotation shaft rotating integrally with the cam member, wherein the rotation shaft is configured to support one of the contact member and the abutment member movably in the axial direction and in a relatively rotatable manner.

5. The sheet conveyance apparatus according to claim 4, wherein the contact member rotates integrally with the rotation shaft, and the abutment member is supported movably and relatively rotatably with respect to the rotation shaft and biased toward the contact member by the biasing member.

6. The sheet conveyance apparatus according to claim 5, further comprising a retention member retaining the biasing member with the abutment member, the retention member retaining the abutment member such that the abutment member is separated from the contact member in a case where the cam member is positioned upstream more than a bottom dead center and upstream more than a top dead center in the direction of rotation.

7. The sheet conveyance apparatus according to claim 2, wherein the contact member includes a different cam surface slanted in a direction opposite from the cam surface in the direction of rotation and abutting against the projection.

8. The sheet conveyance apparatus according to claim 1, wherein one of the first rotator and the second rotator is formed of an elastic roller, and the other is formed of a hard roller having a higher hardness than the elastic roller, the cam member is configured to adjust an amount of penetration of the hard roller against the elastic roller, and the load portion is configured to apply a load on the cam member at least in a case where the cam member receives a rotation force in a same direction as the direction of rotation caused by a restoring force of the elastic roller.

9. The sheet conveyance apparatus according to claim 1, further comprising a one-way clutch arranged within a transmission path through which a driving force of the drive unit is transmitted to the cam member, transmitting the driving force of the drive unit in a first rotating direction to the cam member, and not transmitting a driving force of the drive unit in a second rotating direction opposite to the first direction to the cam member.

10. The sheet conveyance apparatus according to claim 1, further comprising:

a third rotator arranged upstream in a direction of conveyance of a sheet;

a fourth rotator configured to convey a sheet together with the third rotator;

an upstream cam member configured to change a position of the fourth rotator with respect to the third rotator;

a first transmission portion transmitting a driving force of the drive unit to the cam member and not transmitting the driving force to the upstream cam member in a case where the drive unit rotating the cam member and the upstream cam member is driven in a first rotating direction;

a second transmission portion transmitting a driving force of the drive unit to the upstream cam member and not transmitting the driving force to the cam member in a case where the drive unit is driven in a second rotating direction opposite from the first rotating direction; and an upstream load portion configured to apply load to a rotation of the upstream cam member.

11. A sheet conveyance apparatus according to claim 1, wherein the upstream load portion includes:

an upstream contact member in which an upstream cam surface is formed on a side surface in an axial direction of the upstream cam member, an upstream abutment member capable of abutting against the upstream cam surface, and an upstream biasing member configured to bias one of the upstream contact member and the upstream abutment member toward the other in the axial direction of the upstream cam member such that the upstream cam surface of the upstream contact member and the upstream abutment member come into contact each other, and wherein a biasing force of the upstream biasing member in the axial direction of the upstream cam member is converted into a force in a direction opposing to a rotating direction in which the upstream cam member is driven by the drive unit by contact between the upstream cam surface and the upstream abutment member.

12. The sheet conveyance apparatus comprising:

a first rotator;

a second rotator configured to convey a sheet together with the first rotator;

a cam member configured to change a position of the second rotator with respect to the first rotator;

a drive unit configured to rotate the cam member;

a contact member including a cam surface, slanted in an axial direction of the cam member along a direction of rotation, formed on a side surface in the axial direction;

an abutment member having an projection capable of being abutted against the cam surface; and a biasing member configured to bias one of the contact member and the abutment member to the other in the axial direction such that the cam surface and the projection are abutted against one another.

13. The sheet conveyance apparatus according to claim 12, wherein the cam surface is configured to press the projection resisting against a biasing force of the biasing member in a given range where the cam member is positioned downstream more than a top dead center and upstream more than a bottom dead center in a direction of rotation being rotated by the drive unit.

14. The sheet conveyance apparatus according to claim 12, wherein the other one of the contact member and the abutment member rotates integrally with the cam member, and the one of the contact member and the abutment member is supported movably and relatively rotatably with respect to a rotation shaft of the cam member.

15. The sheet conveyance apparatus according to claim 12, wherein one of the first rotator and the second rotator is formed of an elastic roller, and the other is formed of a hard roller having a higher hardness than the elastic roller, the cam member is configured to adjust an amount of penetration of the hard roller against the elastic roller, and the cam surface is configured to press the projection resisting against a biasing force of the biasing member and is configured to apply a load on the cam member at least in a case where the cam member receives a rotation force in a same direction as the direction of rotation caused by a restoring force of the elastic roller.

16. An image forming apparatus comprising:

an image forming portion configured to form an image on a sheet; and the sheet conveyance apparatus according to claim 1.

* * * * *